US009340993B2

(12) United States Patent
Cronk

(10) Patent No.: US 9,340,993 B2
(45) Date of Patent: May 17, 2016

(54) SELF-BRACING SHELTER

(71) Applicant: David C. Cronk, Moab, UT (US)

(72) Inventor: David C. Cronk, Moab, UT (US)

(73) Assignee: HDT Expeditionary Systems, Inc., Solon, OH (US)

( * ) Notice: Subject to any disclaimer, the term of this patent is extended or adjusted under 35 U.S.C. 154(b) by 0 days.

(21) Appl. No.: 14/700,745

(22) Filed: Apr. 30, 2015

(65) Prior Publication Data

US 2015/0315808 A1 Nov. 5, 2015

Related U.S. Application Data

(60) Provisional application No. 61/987,283, filed on May 1, 2014.

(51) Int. Cl.

| | |
|---|---|
| ***E04H 15/20*** | (2006.01) |
| ***E04H 15/36*** | (2006.01) |
| ***E04H 15/42*** | (2006.01) |
| ***E04H 15/34*** | (2006.01) |
| ***E04H 15/32*** | (2006.01) |

(52) U.S. Cl.

CPC ..... *E04H 15/36* (2013.01); *E04H 15/322* (2013.01); *E04H 15/34* (2013.01); *E04H 2015/201* (2013.01); *Y10T 29/49869* (2015.01)

(58) Field of Classification Search

CPC ..... E04H 15/34; E04H 15/36; E04H 15/322; E04H 2015/201

USPC ..... 135/123–126, 128, 138, 117, 905–907

See application file for complete search history.

(56) References Cited

U.S. PATENT DOCUMENTS

| | | | | |
|---|---|---|---|---|
| 3,182,672 | A | 5/1965 | Biller, Jr. | |
| 3,285,257 | A | 11/1966 | Tombari et al. | |
| 3,354,892 | A * | 11/1967 | Frieder | B63B 17/02 114/361 |
| D224,761 | S | 9/1972 | Pohl et al. | |
| 4,165,757 | A * | 8/1979 | Marks | E04H 15/14 135/119 |
| 4,269,210 | A * | 5/1981 | Marks | E04H 15/14 135/125 |
| 4,393,887 | A | 7/1983 | Orobin | |
| 4,709,718 | A | 12/1987 | Nichols | |
| 4,719,934 | A * | 1/1988 | Mydans | E04H 15/40 135/121 |
| 5,421,128 | A | 6/1995 | Sharpless et al. | |
| 5,584,311 | A | 12/1996 | Schaefer | |
| 5,595,203 | A * | 1/1997 | Espinosa | E04H 15/36 135/123 |
| 5,677,023 | A | 10/1997 | Brown | |
| 5,735,083 | A | 4/1998 | Brown et al. | |
| D403,041 | S | 12/1998 | Funk | |
| 6,263,617 | B1 | 7/2001 | Turcot et al. | |
| 6,679,009 | B2 | 1/2004 | Hotes | |
| 6,758,230 | B2 * | 7/2004 | Bogart, Jr. | E04H 6/44 135/124 |
| 7,089,951 | B2 * | 8/2006 | Bogart | E04H 6/44 135/115 |
| D534,614 | S | 1/2007 | Gallaway et al. | |

(Continued)

*Primary Examiner* — Robert Canfield

(74) *Attorney, Agent, or Firm* — Fay Sharpe LLP

(57) ABSTRACT

A self-bracing shelter includes a frame and a skin. First and second subframes are arranged in vertical planes, each including first and second feet and a central portion. A ridge beam extends axially between the first and second subframes and includes opposite first and second ends that extend axially beyond the first and second subframes, respectively, such that the opposite ends of the beam are located outside a footprint of a planform defined by the feet of the subframes. A first pair of outer tension members is connected between the first end of the beam and the first subframe on opposite sides of the beam. A second pair of outer tension members is connected between the second end of the beam and the second subframe on opposite sides of the beam.

18 Claims, 6 Drawing Sheets

(56) References Cited

U.S. PATENT DOCUMENTS

| | | | |
|---|---|---|---|
| 7,607,445 | B2 | 10/2009 | Von Dewitz et al. |
| D609,766 | S | 2/2010 | Wilgus et al. |
| 8,220,475 | B2 | 7/2012 | Yul et al. |
| D687,116 | S | 7/2013 | Jin |
| 2004/0168715 | A1 | 9/2004 | Wang |
| 2005/0150534 | A1 | 7/2005 | Scherer |
| 2007/0240747 | A1 | 10/2007 | Scherer |
| 2010/0065095 | A1 | 3/2010 | Yul et al. |
| 2013/0061898 | A1 | 3/2013 | Webster et al. |

* cited by examiner

SELF-BRACING SHELTER

CROSS-REFERENCE TO RELATED APPLICATION

This application claims priority from and benefit of the filing date of U.S. provisional application Ser. No. 61/987,283 filed May 1, 2014 (May 1, 2014), and the entire disclosure of said prior application is hereby expressly incorporated by reference into the present specification.

FIELD

The present disclosure concerns a self-bracing shelter including a structural frame and a skin assembly, skin or fabric material supported by the frame. The self-bracing shelter provides the required structural strength with a reduced weight and packed volume. In certain embodiments, the self-bracing shelter provides the necessary structural strength using ground anchors that are located only within the habitable footprint or planform of the shelter so as to avoid ground anchors, ropes and/or guys that present a trip or entanglement hazard to persons in the area outside the shelter. The self-bracing shelter is intended to reduce the time and number of persons needed to deploy and erect the shelter.

BACKGROUND

Soft-walled shelters, such as tents, comprise a structural frame covered by a fabric skin. The structural frame provides the strength and stiffness needed for a specified set of environmental conditions from which design loads are determined. Such structural frames utilize various types and configurations of structural elements in order to achieve the required strength and resistance to deflection under load, or stiffness. One such structural configuration utilizes parallel sub-frames, generally in the form of arches, to provide lateral strength and stiffness, with additional structure for longitudinal strength. Two known ways for providing longitudinal strength are: (i) external guying, in which additional ground anchors that are located outside the structural footprint are used to pull the end sub-frames outward with guy ropes and thus tension the shelter skin; or (ii) internal bracing, in which multiple purlins and/or diagonal braces provide the required longitudinal strength. The use of additional purlins or braces is disadvantageous.

Another structural element of known soft-wall shelters is multiple ground anchors. Ground anchors are necessary for lightweight shelters in order to resist loads imposed by a specified wind velocity. Ground anchors are commonly relied upon to provide horizontal reaction forces to frame elements in contact with the ground. For example, an arch with a distributed vertical load will tend to widen, or spread, at its ground contact unless restrained. Ground anchors are one method for providing such restraint by horizontal reaction forces. However, one disadvantage of ground anchors is that they are located outside the habitable footprint of softwall shelters and are attached to points on the shelter skin or frame with ropes or guys to enhance the strength and stiffness of the shelter.

SUMMARY

The current disclosure relates to a new construction or system for providing longitudinal strength and stiffness in a soft-walled shelter without the need for ground anchors outside of the shelter footprint, and without needing to use a multitude of additional internal structural elements.

In accordance with one aspect of the present development, a self-bracing shelter includes a frame and a skin connected to the frame to define an internal space. The frame includes first and second subframes arranged in respective vertical planes, each subframe including first and second feet adapted to engage a support surface and a central portion that extends between and interconnects the first and second feet. A ridge beam extends axially between and interconnects the central portion of the first and second subframes. The ridge beam comprises opposite first and second ends that extend axially beyond the first and second subframes, respectively. The shelter further includes a first pair of outer tension members, wherein each tension member of the first pair is connected at an outer end to the first end of the ridge beam and each tension member of the first pair is connected at an inner end to the first subframe. The respective inner ends of the first pair of outer tension members are connected to the first subframe on opposite lateral sides of said ridge beam at a location spaced laterally from the ridge beam. The shelter further includes a second pair of outer tension members, wherein each tension member of the second pair is connected at an outer end to the second end of the ridge beam and each tension member of the second pair is connected at an inner end to the second subframe. The respective inner ends of the second pair of outer tension members are connected to the second subframe on opposite lateral sides of the ridge beam at a location spaced laterally from the ridge beam. The first and second pairs of outer tension members urge the first and second sub-frames outwardly away from each other.

In accordance with another aspect of the present development, a method of providing a self-bracing shelter includes erecting a frame and connecting a fabric skin to the frame to define an internal space. The step of erecting a frame includes arranging first and second subframes in respective vertical planes, each subframe comprising first and second feet adapted to engage a support surface and a central portion that extends between and interconnects the first and second feet. The method further includes connecting a ridge beam to the first and second subframes so that the ridge beam extends axially between and interconnects the central portions of the first and second subframes, the ridge beam comprising opposite first and second ends that extend axially beyond the first and second subframes, respectively. A first pair of outer tension members is connected between the first end of the ridge beam and the first subframe, wherein respective outer ends of the first pair of outer tension members are connected to the first end of the ridge beam and respective inner ends of the first pair of outer tension members are connected to the first subframe on opposite lateral sides of the ridge beam and spaced laterally outward from the ridge beam to urge the first subframe outwardly away from the second subframe. A second pair of outer tension members is connected between the second end of the ridge beam and the second subframe, wherein respective outer ends of the second pair of outer tension members are connected to the second end of the ridge beam and respective inner ends of the second pair of outer tension members are connected to the second subframe on opposite lateral sides of the ridge beam and spaced laterally outward from the ridge beam, to urge the second subframe outwardly away from the first subframe.

BRIEF DESCRIPTION OF THE DRAWINGS

The present disclosure may take physical form in certain parts and arrangements of parts, several embodiments of which will be described in detail in this specification and illustrated in the accompanying drawings which form a part hereof and wherein.

DETAILED DESCRIPTION

It should be understood that the description and drawings herein are merely illustrative and that various modifications and changes can be made in the structures disclosed without the departing from the scope of the present disclosure.

Figure 1:
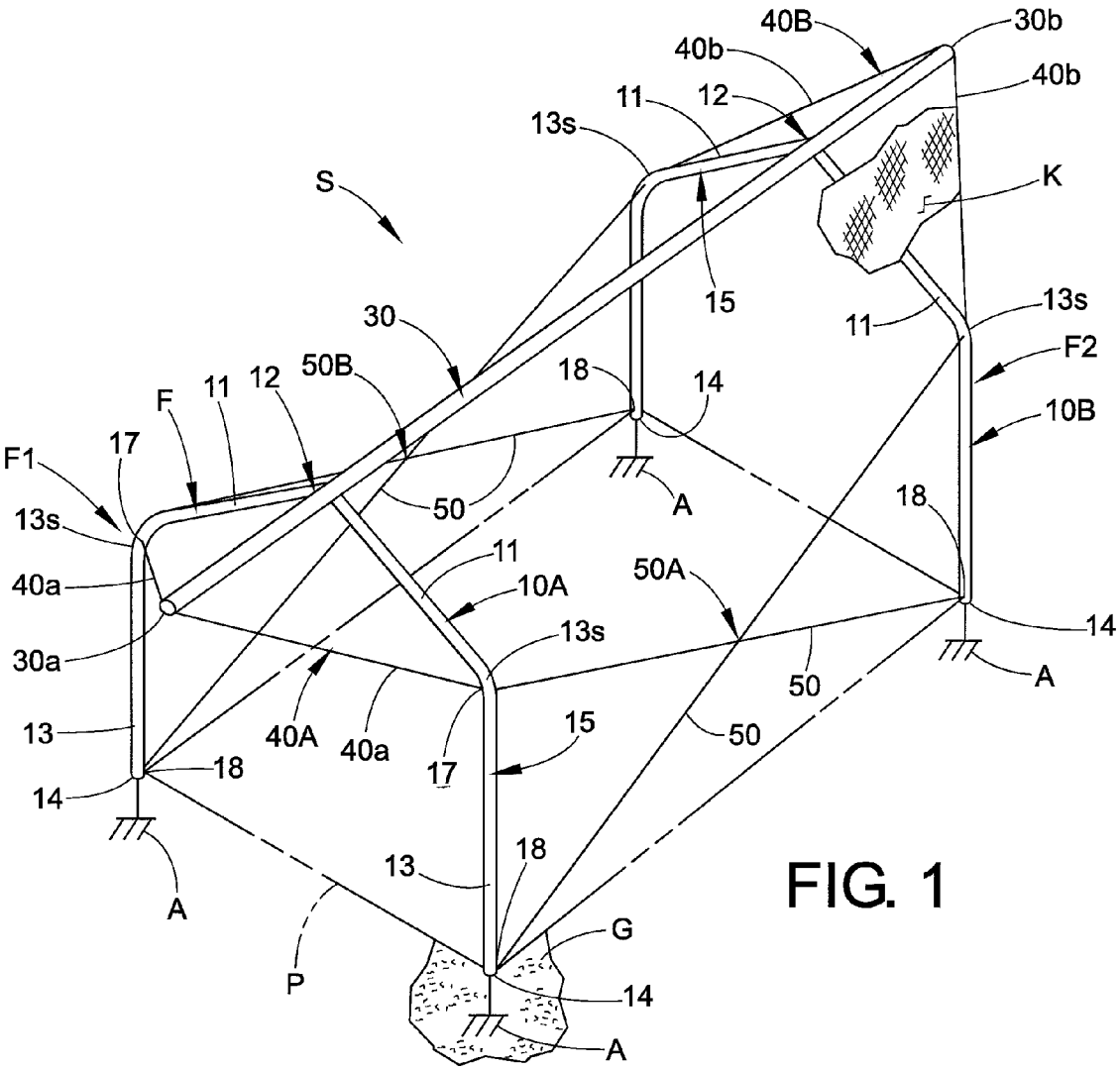
FIG. 1 is an isometric view of a shelter frame provided in accordance with a first embodiment of the present disclosure and comprising at least first and second segmented or linear segment arch subframes connected by a longitudinally extending ridge beam.

Referring to FIG. 1, the present development comprises a self-bracing shelter S comprising a shelter frame F and a skin assembly, fabric material, or "skin" K (only partially shown in FIG. 1) draped over and/or otherwise connected to and supported by the shelter frame F so that the skin K defines a soft-walled enclosed space within the structure of the frame F. The skin assembly K is fabricated from shear-resistant fabric such as bias-oriented fabric, and optionally includes the diagonal or otherwise oriented webbing reinforcement to enhance shelter longitudinal strength and stiffness as described below in relation to FIG. 4.

The shelter frame F comprises at least first and second parallel and axially spaced-apart arch subframes 10A,10B (generally referred to using the reference number "10") located respectively adjacent opposite first and second ends F1,F2 of the shelter frame. In the illustrated embodiment, the first and second arch subframes 10A,10B preferably have an identical or at least substantially identical structure with respect to each other, but this need not be the case in all embodiments. Also, while the first and second arch subframes 10A,10B are located respectively adjacent the opposite first and second ends F1,F2 of the frame F, the frame further optionally comprises one or more intermediate arch subframes that are structured identical or similar to the first and second arch subframes 10A,10B and that are located between the first and second arch subframes 10A,10B in a corresponding parallel spaced-apart arrangement. Each arch subframe 10 includes first and second feet 14 located on opposite lateral sides of an apex 12 and adapted to engage the earth or other support surface on which the shelter S is erected. Each subframe 10A,10B further comprises a central portion 15 that extends between and interconnects the feet 14, of which the apex 12 is the highest point above the feet 14 when the subframe is operably positioned as shown.

The shelter frame F further comprises a longitudinally extending linear ridge beam 30 that extends axially between and that interconnects the central portion 15 of the first and second arch subframes 10A,10B. The ridge beam 30 extends axially beyond the rectangular footprint (shown in phantom lines at P) defined by the planform of the subframes, i.e., the planform is defined by a polygon (rectangle) defined with the feet of 14 the first and second subframes 10A,10B located at its corners, and the ridge beam 30 extends in first and second directions axially outside the planform beyond the first and second arch subframes 10A,10B located at opposite first and second ends F1,F2 of the shelter frame F. In the illustrated embodiment, the ridge beam 30 is connected at or at least located adjacent to the apex 12 of each arch subframe 10A, 10B. The ridge beam 30 can be provided as a one-piece or a multi-piece structure defined from a metal such as aluminum, wood, polymeric, a composite structure such as a glass fiber or other reinforced polymeric material, or any other suitable material and can be solid or tubular with any desired cross-sectional shape such as circular or square. In another embodiment, the ridge beam 30 optionally comprises an inflatable tubular structure that is collapsible when deflated and that assumes the described and illustrated beam shape when inflated. Such inflatable tubular structures are described in U.S. Pat. Nos. 5,735,083; 5,421,128; and 5,677,023, the entire disclosures of which are hereby expressly incorporated hereinto by reference.

At its first end F1, the shelter frame F further comprises a first pair 40A of diagonally extending outer tension members 40*a* comprising cables, ropes, straps, or the like. The first pair 40A includes left (first) and right (second) tension members 40*a*, and each tension member 40*a* includes a first or outer end connected to the ridge beam 30 at a location between its first end 30*a* and the first arch subframe 10A, preferably at or adjacent a first outermost end 30*a* of the ridge beam 30. Each of the outer tension members 40*a* of the first pair 40A also includes a second or inner end connected to the first arch subframe 10A at an attachment location 17 positioned between the apex 12 of the arch subframe 10A and a respective one of the feet 14, laterally outward from the ridge beam 30 so that the inner ends of the tension members 40*a* are located on opposite lateral sides of the ridge beam 30. The constituent tension members 40*a* of the first pair 40A of outer tension members can be provided by separate cables or other members or they can both be provided by a single cable having opposite ends connected to the arch subframe 10A at respective attachment locations 17 on opposite lateral sides of the ridge beam 30 and a central portion connected to or adjacent the first end 30*a* of the ridge beam 30.

At its second end F2, the shelter frame F further comprises a second pair 40B of diagonally extending outer tension members 40*b* comprising cables, ropes, straps, or the like. The second pair 40B includes left (first) and right (second) tension members 40*b*, and each tension member 40*b* includes a first or outer end connected to the ridge beam 30 at a location between its second end 30*b* and the second arch subframe 10B, preferably at or adjacent the second outermost end 30*b* of the ridge beam 30. Both outer tension members 40*b* of the second pair 40B also include a second or inner end connected to the second arch subframe 10B at an attachment location 17 positioned between the apex 12 of the arch subframe 10B and a respective one of the feet 14, laterally outward from the ridge beam 30 so that the inner ends of the tension members 40*b* are located on opposite lateral sides of the ridge beam 30. The constituent tension members 40*b* of the second pair 40B of outer tension members can be provided by separate cables or other members or they can both be provided by a single cable having opposite ends connected to the second arch subframe 10B at respective attachment locations 17 on opposite lateral sides of the ridge beam and a central portion connected to or adjacent the second end 30*b* of the ridge beam 30.

The first and second pairs 40A,40B of diagonal tension members 40*a*,40*b* are tensioned to urge the first and second arch sub-frames 10A,10B outwardly away from each other. This provides tension in the shelter skin K from which longitudinal strength and stiffness are derived, utilizing the shear strength of the shelter skin K, itself.

As described further below, longitudinal strength and stiffness of the shelter S is optionally further enhanced by additional first and second pairs 50A,50B of inner tension members 50 attached to and extending between the first and second arch subframes 10A,10B and arranged in a crossing diagonal "X-shaped" pattern. These pairs 50A,50B of tension members 50 are respectively located on opposite lateral sides of the shelter S. Each inner tension member 50 comprises a cable, rope, strap, or any other flexible tension member that extends from a first or lower end connected adjacent the foot of one of the subframes 10A,10B to a second or upper end connected to the other one of the subframes 10A,10B at a location vertically above its foot 14, preferably in the region of the attachment location 17 for the respective outer tension member 40*a*,40*b*. More particularly, the first pair 50A of inner tension members comprises a first inner tension member 50 that extends between a location adjacent a first one of said feet 14 of said first subframe 10A and said second subframe 10B, and a second inner tension member 50 that extends between a location adjacent a first one of said feet 14 of said second subframe 10B and said first subframe 10A. The second pair 50B of inner tension members comprises a first inner tension member 50 that extends between a location adjacent a second one of said feet 14 of said first subframe 10A and said second subframe 10B, and a second inner tension member 50 that extends between a location adjacent a second one of said feet 14 of said second subframe 10B and said first subframe 10A.

With continuing reference to FIG. 1, the arch subframes 10 of the present embodiment are shown as segmented arches each comprising an upper portion including left and right upper linear segments 11 that converge at the apex 12, and each comprising a lower portion comprising left and right lower linear segments or legs 13 that are arranged vertically and that include or define one of the feet 14 at a lower end and that are respectively connected to the left and right upper segments 11 to define respective left and right shoulders 13*s* at the juncture of the left and right legs 13 with the left and right upper segments 11, respectively. Each of segmented arches 10 is defined as a one-piece or a multi-piece structure such as a tubular or bar structure. In one example, the segmented arch subframes comprise collapsible inflatable structures that assume the described and illustrated shape when inflated. Alternatively, the segmented arches 10 can each comprise a foldable structure that can be collapsed upon itself for storage and transportation. All of the segmented arch subframes 10 are arranged parallel to each other in respective vertical planes and are axially spaced-apart from each other, with their respect feet 14 in contact with the earth/ground G. Ground anchors A such as stakes or the like are inserted into the ground G and are each connected directly or by a tether to a respective foot 14 to prevent movement of the arch subframes 10 at their points of contact with the ground G. The ridge beam 30 rests on and is attached to the subframes 10, preferably at or adjacent their highest point, i.e., their apex 12, using a suitable connection such as brackets, straps, cables, connectors, and/or other suitable means. The ridge beam 30 extends axially horizontally beyond both the first and second arch subframes 10A,10B located at the opposite ends F1,F2 of the frame F so as to extend axially outside the habitable footprint of the shelter planform P. This structural arrangement is advantageous in that the opposite first and second ends 30*a*,30*b* of the ridge beam 30 are located such that the first and second pairs of outer tension members 40A,40B can be connected respectively thereto at locations outside the planform P defined between the feet 14 of the first and second arch subframes 10A,10B as required for the first and second pairs of tension members 40A,40B to pull the first and second arch subframes 10A,10B outwardly away from each other when the first and second pairs of tension members 40A,40B are tensioned. The ground anchors A are preferably also located within the shelter planform P.

The left (first) and right (second) cables or other tension members 40*a* of the first pair of diagonally extending outer tension members 40A are attached at their outer ends to the ridge beam 30 adjacent its first end 30*a* and at their respective inner ends to the first arch subframe 10A at connection locations 17. Similarly, the left (first) and right (second) cables or other tension members 40*b* of the second pair of diagonally extending outer tension members 40B are attached at their outer ends to the ridge beam 30 adjacent its second end 30*b* and at their respective inner ends to respective attachment locations 17 on the second arch subframe 10B. The position of the attachment locations 17 can vary depending on specific design requirements but, in general, the attachment locations are situated adjacent the shoulder regions of the respective arch subframe 10 where the upper segments 11 join the lower segments 13 to define a shoulder so that the inner ends of the first and second pairs of outer tension members 40A,40B are located above the head height of persons walking near the outside of the shelter S.

The optional first and second pairs of inner tension members 50 that are attached to and extend between the first and second arch subframes 10A,10B on opposite lateral sides of the shelter frame F are preferably also connected at one end to or adjacent the connection location 17 of one of the first and second arch subframes 10A,10B, and are connected at the other end to the other one of the first and second arch subframes 10A,10B adjacent its foot at a connection location 18. These inner tension members 50 are preferably arranged in a crossing diagonal "X-shaped" pattern on both lateral sides of the shelter frame F. The connection locations 17,18 and the connection of the outer tension members 40*a*,40*b* to the ridge beam 30 are provided by suitable hardware fittings or other connection structures suitable for connecting a cable, rope, or other tensioner member 40*a*,40*b*,50 to the frame F. In the case where the frame F includes one or more additional intermediate arch subframes 10 located axially between the first and second arch subframes 10A, 10B, the opposite ends of the inner tension members 50 can be arranged to extend between and interconnect any two of the arch subframes 10, and the inner tension members can also be connected to or engaged with any subframe 10 located between the opposite ends of the inner tension members. Also, multiple pairs of inner tension members 50 can be used, with each pair located between and interconnecting any two spaced-apart subframes 10.

The shelter frame F of FIG. 1 is capable of resisting longitudinal forces on the shelter S by the action of the side diagonal tension elements 50 that prevent the subframes 10 from deflecting from their vertical orientation. The resulting tension in the inner or side diagonal tension elements 50 is carried through subframe attachments points 17, and continues through the outer tension elements 40A,40B, thus becoming compression in the ridge beam 30. This load path helps the subframes 10 resist out-of-plane bending deflections, thus greatly stiffening the shelter structure.

Figure 2:
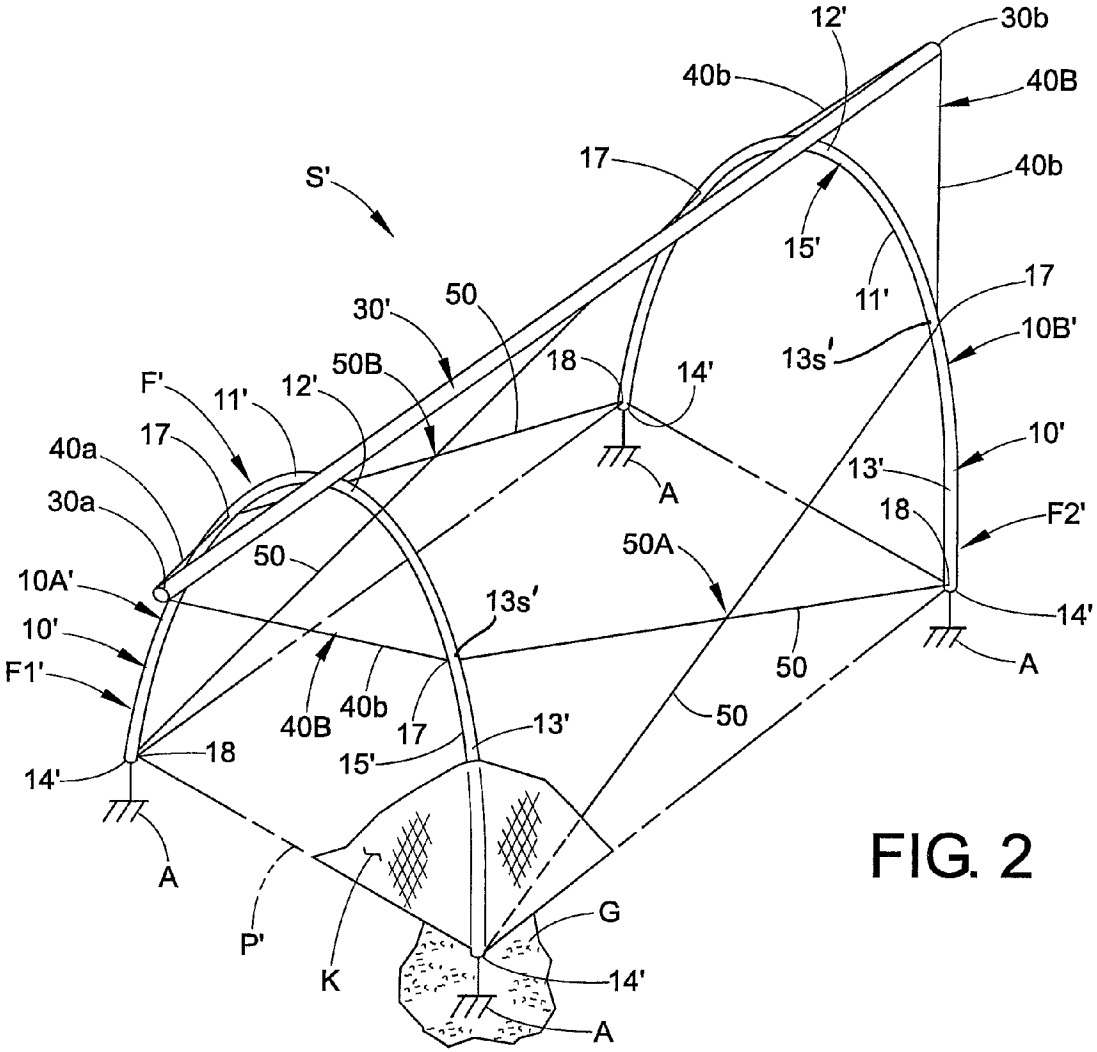
FIG. 2 is similar to FIG. 1 in that it shows an isometric view of an alternative embodiment of a shelter frame according to the present disclosure in which the segmented arch subframes are replaced by continuously curved arch subframes.

FIG. 2 illustrates an alternative embodiment of a shelter S' that is identical to the shelter S except as otherwise shown and/or described herein. Like components of the shelter S' as compared to the shelter S are identified using like reference characters, except that components or structures that are modified as compared to the shelter S are identified with reference characters that include a primed (') designation. The shelter S' comprises a frame F' that is similar to the frame F and a skin assembly or skin K that is identical to the skin K described above and that is connected to the frame F' to define an enclosed space within the shelter S'. The frame F' of the shelter S' differs from the frame F described above in that it includes continuous arch subframes 10A',10B' (generally 10') that define a continuously curved arch shape instead of an arch shape comprising linear segments. The term "arch" as used herein is intended to encompass both a segmented arch defined by the segmented arch subframe 10 and also a continuous arch 10' defined by the continuous arch subframe 10'. The continuous arch subframes 10' of the FIG. 2 embodiment each comprise an upper continuously curved portion including left and right upper curved segments 11' that converge at the apex 12', and each comprise a lower continuously curved portion comprising left and right lower curved segments or legs 13' that each include or define a foot 14' at a lower end for abutting the earth G or other support surface. The left and right lower curved segments 13' are respectively connected to the left and right upper curved segments 11' at left and right shoulders 13*s*', and the left and right upper curved segments are joined at the apex 12' to define each continuously curved arch subframe 10'. Each of the continuously curved arches 10' is defined as a one-piece construction or is defined as a multi-piece structure using multiple curved segments that are interconnected. In one example, the curved arch subframes 10' each comprise a single or multiple interconnected collapsible inflatable structures that assume the described and illustrated shape when inflated. The first and second curved arch subframes 10' are arranged parallel to each other in respective vertical planes and are axially spaced-apart from each other, with their respect feet 14' in contact with the earth/ground G. Ground anchors A such as stakes or the like are inserted into the ground G and are each connected directly or by a tether to a respective foot 14' to prevent movement of the arch subframes 10' at their points of contact with the ground G. Ground anchors A are preferably also located within the shelter planform P'.

As described above in relation to the shelter S, the ridge beam 30' is connected to the subframes 10', preferably at or adjacent their highest point, i.e., their apex 12', using a suitable connection such as brackets, straps, cables, connectors, and/or other suitable means. The ridge beam 30' extends continuously between and axially horizontally beyond both the first and second arch subframes 10A',10B' located at the opposite first and second ends F1',F2' of the frame F' so as to extend axially outside the habitable footprint of the shelter planform F. The frame includes first and second pairs 40A, 40B of outer tension members respectively comprising left and right first outer tension members 40*a* and left and right second outer tension members 40*b*. Each of the first outer tension members 40*a* is connected at a first or outer end to the ridge beam 30' at or adjacent the beam first end 30*a*' at a location outside the frame planform/footprint P', and is connected at its second or inner end to the first arch subframe 10A' at an attachment location 17 adjacent the respective left and right shoulders 13*s*', with the first outer tension members 40*a* connected to the first arch subframe 10A' on opposite lateral sides of the ridge beam 30'. Similarly, each of the second outer tension members 40*b* is connected at a first or outer end to the ridge beam 30' at or adjacent the beam second end 30*b*' at a location outside the frame planform/footprint P', and is connected at its second or inner end to the second arch subframe 10B' at an attachment location 17 adjacent the respective left and right shoulders 13*s*', with the second outer tension members 40*b* connected to the second arch subframe 10B' on opposite lateral sides of the ridge beam 30'. As such, the first and second pairs of tension members 40A',40B' pull the first and second arch subframes 10A',10B' outwardly away from each other when the first and second pairs of tension members 40A',40B' are tensioned.

As with the shelter frame F, the shelter frame F' optionally further comprises first and second pairs of inner tension members 50 attached to and extending between the first and second arch subframes 10A',10B' and arranged in a crossing diagonal "X-shaped" pattern on both lateral sides of the shelter S. A first end of each inner tension member 50 is connected to one of the first and second arch subframes 10A',10B' at or adjacent the attachment location 17 and is connected to the other one of the first and second arch subframes 10A',10B' at an attachment location 18 adjacent the foot 14'. These inner tension members 50 are preferably arranged in a crossing diagonal "X-shaped" pattern on both lateral sides of the shelter frame F'. The connection locations 17,18 and the connection of the outer tension members 40*a*,40*b* to the ridge beam 30 are provided by suitable hardware fittings or other connection structures suitable for connecting a cable, rope, or other tensioner member 40*a*,40*b*,50 to the frame F'.

FIGS. 3A, 3B, 3C, and 3D are respective top, side, end and isometric views of a soft-walled self-bracing shelter S' comprising a skin or skin assembly K supported by a continuous arch shelter frame similar to that shown in FIG. 2. The skin K comprises one or more optional openings or windows W shown in broken lines. Windows W optionally comprise a transparent or translucent flexible polymeric sheet and/or optionally comprise a screen structure such as netting or the like. A door D is provided by a flap of the skin K or by a rigid member connected to the frame F' and aligned with an opening in the skin K.

Figure 3D:
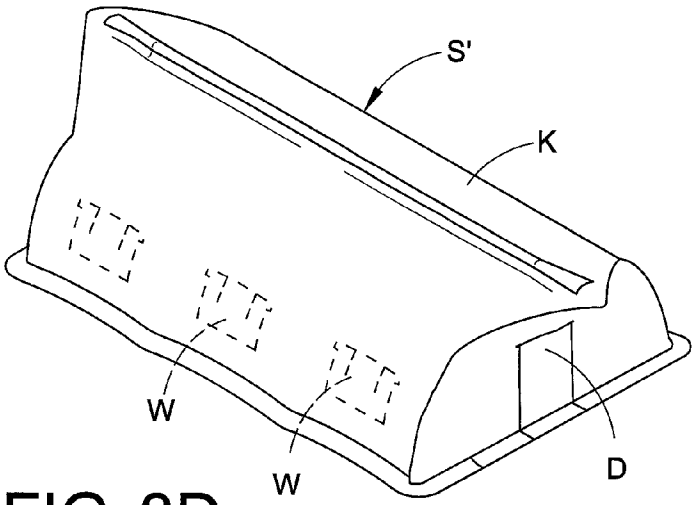
FIGS. 3A, 3B, 3C, and 3D are respective top, side, end and isometric views of a self-bracing shelter comprising a skin or skin assembly supported by a continuous arch shelter frame similar to that shown in FIG. 2.
Figure 3C:
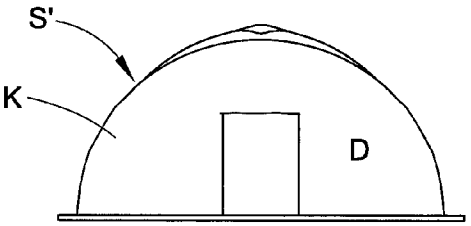
Figure 3A:
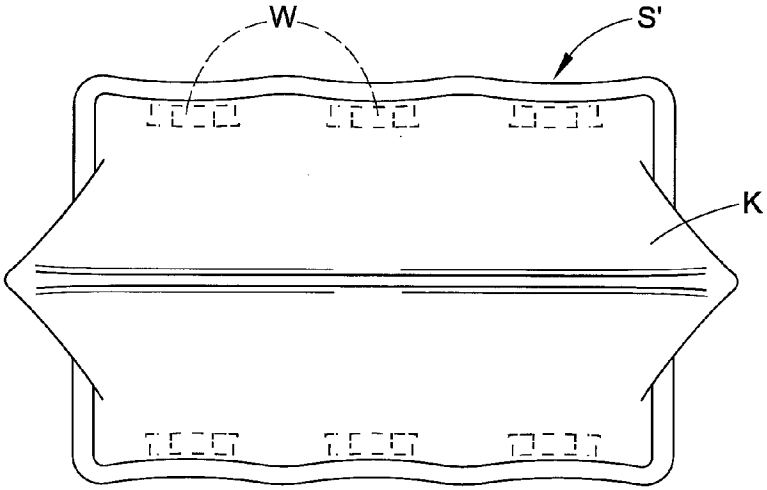
Figure 3B:
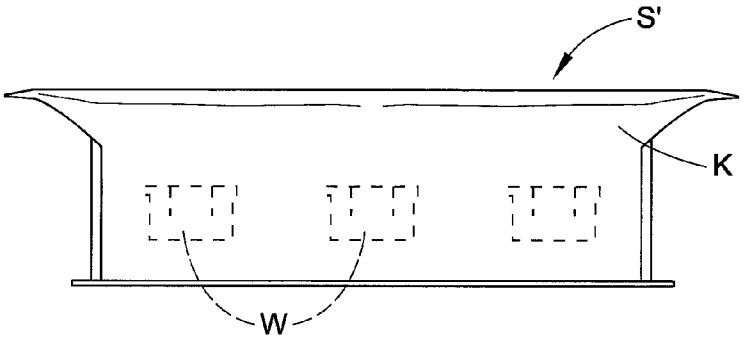
Figure 4:
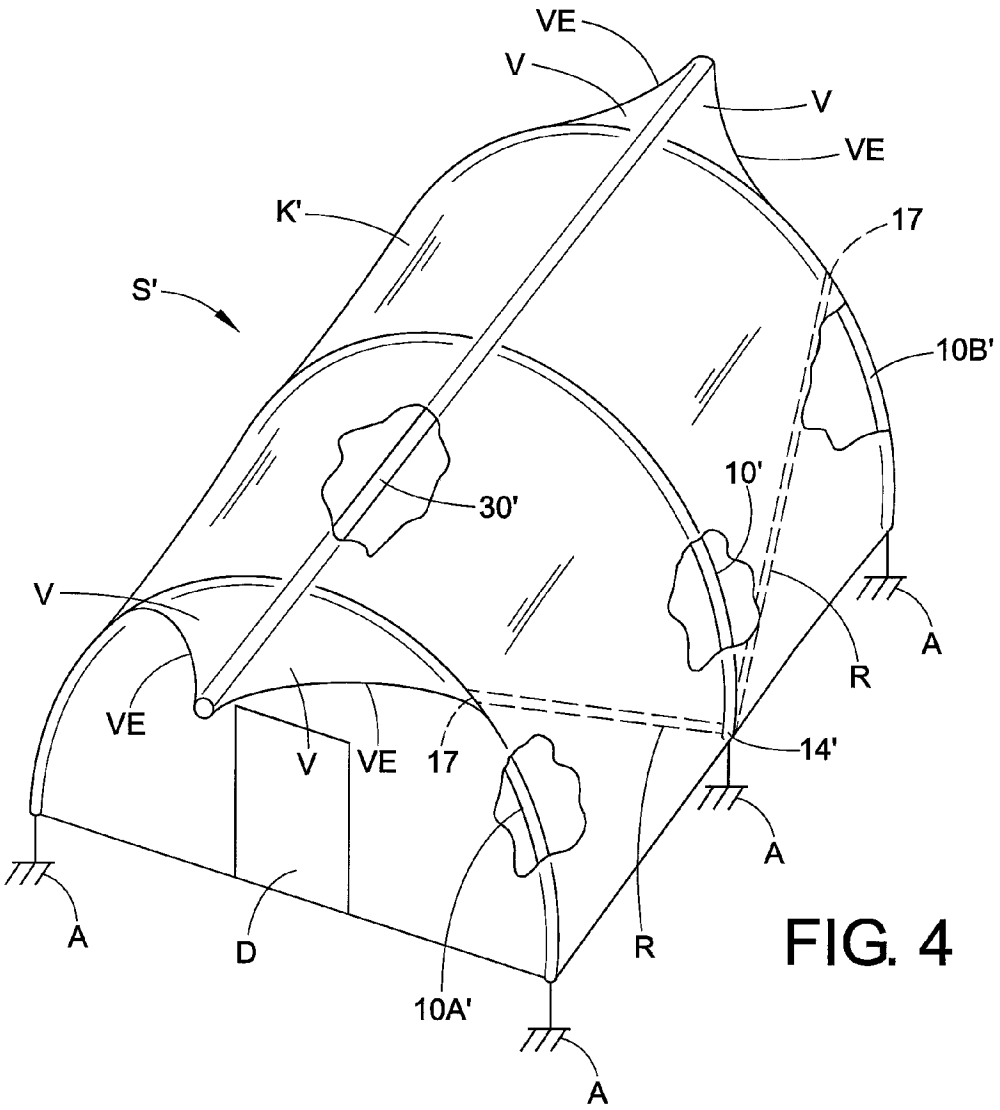
FIG. 4 is similar to FIG. 3D and shows an isometric view of an embodiment of a self-bracing shelter comprising a continuous arch subframe similar to that shown in FIG. 2 and a skin assembly that comprises optional diagonal webbing reinforcement to enhance the strength and stiffness of the shelter according to a further embodiment of the present disclosure.

FIG. 4 is similar to FIG. 3D and shows an embodiment of a self-bracing shelter S' comprising a continuous arch subframe and that comprises an alternative skin K' including optional fabric, cord, or other flexible webbing reinforcement R sewn or otherwise integrated into the skin K' to enhance the strength and stiffness of the shelter S'. As shown, the webbing reinforcement R is diagonally arranged so as to extend from a point adjacent the attachment location 17 of each of the first and second subframes 10A',10B' toward a central location adjacent a foot 14' of a central arch subframe 10' near a lower edge of the skin K'. Otherwise the skin K' is identical to the skin K described above. Those of ordinary skill in the art will recognize that the webbing reinforcement R can be used to define and provide the inner tension members 50 as an integral part of the skin K' in that the webbing reinforcement R provides a means for integrating the inner tension members 50 into the skin K', in which case separate cables or other inner tension members 50 are optionally not required.

FIG. 4 also shows that the skin K' (and skin K) can optionally include triangular vestibule panels V incorporated into skin assembly K' to provide a shelter S' with a sheltered area or vestibule located outside and adjacent the door D adjacent one or both ends F1',F2' of the frame F'. The vestibule panels V are located between the ridge beam 30' and the first and second pairs of outer tension members 40A,40B. The vestibule panels V comprise reinforced edges VE that provide high strength attachments to the distal ends 30*a*',30*b*' of the ridge beam 30'. In one embodiment, the reinforced edges VE are used to provide and define the first and second pairs of outer tension members 40A,40B to provide the required tension in the frame F,F', i.e., the reinforced edges VE of the vestibule panels extend between the outer ends of the ridge beam 30,30' and urge the subframes 10,10' outwardly away from each other. Stated another way, in such an alternative embodiment, the vestibule panels V and the reinforced edged thereof define or provide the first and/or second pairs 40A,40B of outer tension members such that separate cables or other outer tension members 40*a*,40*b* can optionally be eliminated because same are integrated into the skin K'. The curvature of reinforced edges VE helps distribute tension across the first and second subframes 10A',10B' and into the skin assembly K. As with the skin assembly K, the skin assembly K' is fabricated from shear-resistant fabric, bias-oriented fabric, and optionally includes the diagonal or otherwise oriented webbing reinforcement R to enhance shelter longitudinal strength and stiffness.

Figure 5A:
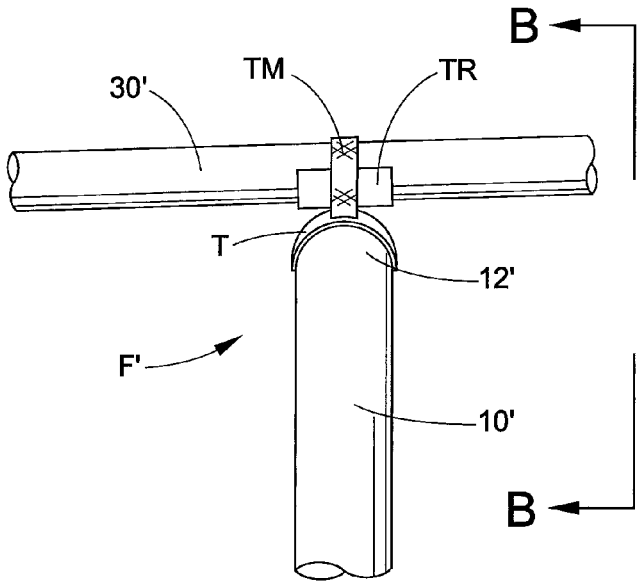
FIG. 5A is a partial side view of the shelter frame of FIG. 2.
Figure 5B:
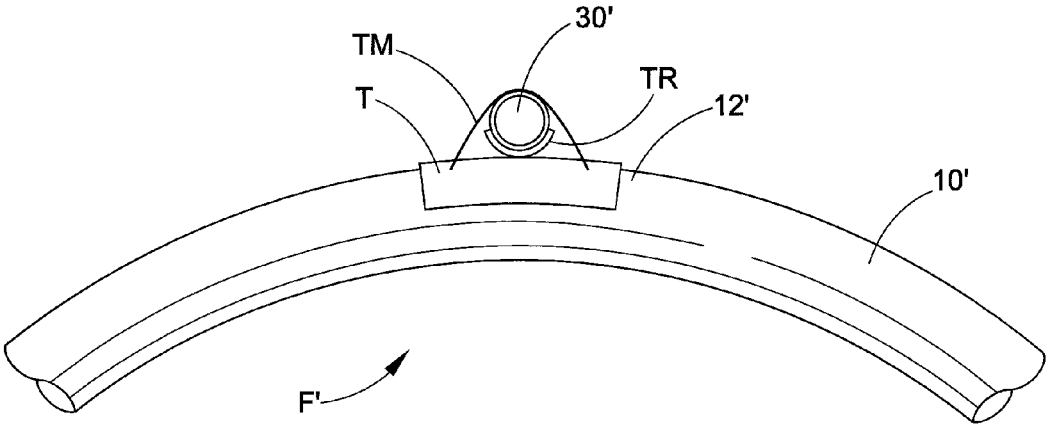
FIG. 5B is an end view as taken at B-B in FIG. 5A.

FIG. 5A is a partial side view of the shelter frame F' of FIG. 2, and FIG. 5B is an end view taken at B-B in FIG. 5A. It can be seen that, in the illustrated embodiment, the frame is constructed such that the ridge beam 30' is located on top of the arched subframes 10' at the apex 12, i.e., the ridge beam is located outside the arch defined by each subframe 10'. A bracket T is secured to the arched subframe 10' and includes a U-shaped recess TR that received and supports the ridge beam 30'. A rope, strap or other securing member TM is used to secure the ridge beam 30' in the bracket recess TR. The frame F of FIG. 1 is similarly constructed with the ridge beam 30 connected to the segmented arch subframes 10 in a corresponding manner.

Figure 6A:
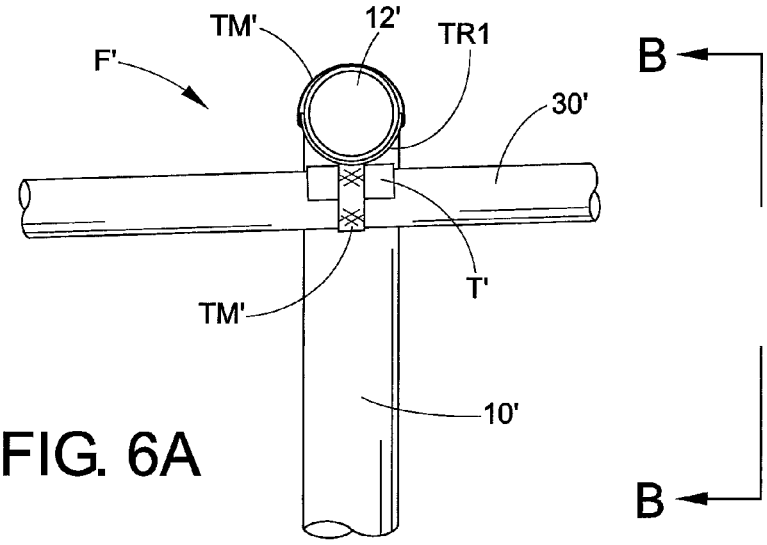
FIG. 6A is similar to FIG. 5A but shows an alternative embodiment in which a longitudinally extending ridge beam is located inside or beneath each arch subframe.
Figure 6B:
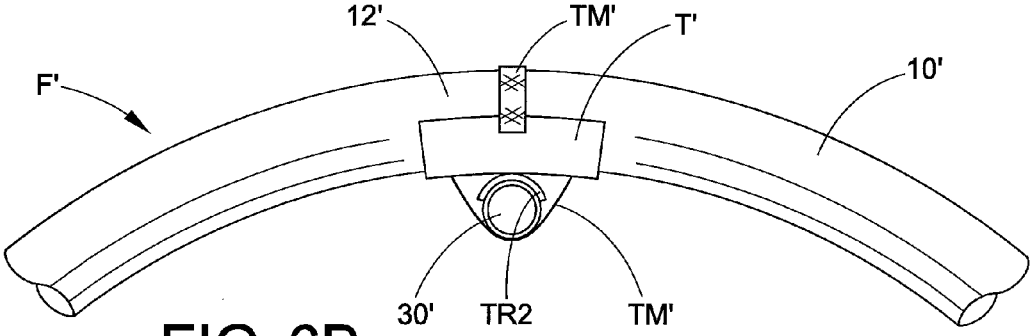
FIG. 6B is an end view as taken at B-B in FIG. 6A.

Alternatively, the frame F,F' is constructed as shown in FIGS. 6A and 6B, wherein the ridge beam 30' is connected to each arch subframe 10' inside the arch beneath or under the apex 12' using a bracket T' including first and second recesses TR1,TR2 engaged respectively with the arch subframe 10' and the ridge beam 30'. The bracket T' is secured to both the arch subframe 10' and the ridge beam 30' using respective straps or other flexible securing members TM'.

Figure 7:
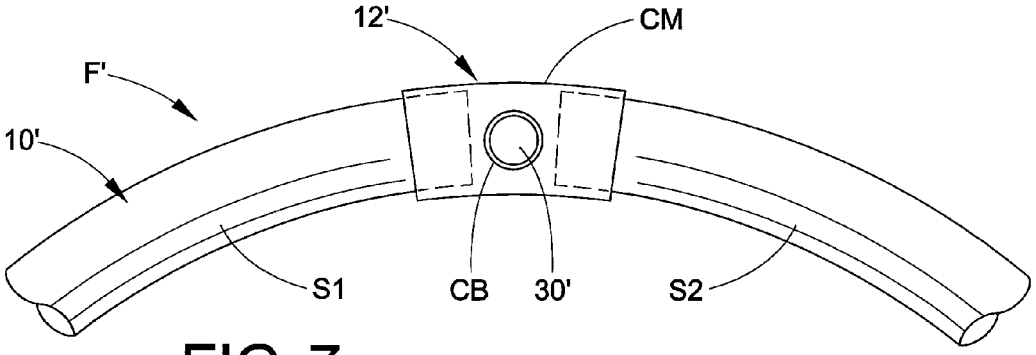
FIG. 7 shows another alternative embodiment for connecting the ridge beam to the arched subframes.

FIG. 7 shows yet another alternative embodiment in which the arch subframes 10' comprise first and second arch segments S1, S2 joined together by a metallic, polymeric, or other coupling member CM located at the apex 12'. The coupling member CM receives and retains the upper ends of each arch segment S1,S2 and includes a bore CB that extends therethrough and through which the ridge beam 30' extends so as to be engaged with the arch subframe 10'. Although the coupling member CM is shown in conjunction with the continuous arch subframes 10' of the frame F', the coupling member CM can also be used in a corresponding manner to connect the ridge beam 30 to the segmented arch subframes 10 of the frame F.

As noted, a frame F or F' according to the present development may include any number of subframes 10,10' equal to or greater than two, and the subframes 10,10' need not match each other, i.e., a segmented arch subframe 10 can be used with a continuous arch subframe 10'. It is further understood that the subframes 10,10' are shown in the form of a continuous or segmented arches, but may, more generally, be any type of structure that has contact with the ground in two places and serves to support the shelter skin K. It is further noted that structural elements used to define the subframes 10,10' and/or the ridge beam 30,30' may be of a variety of types, including inflatable, wood, polymeric, metallic or fiber-reinforced composite. Suitable examples of inflatable tubular beam structures are described in U.S. Pat. Nos. 5,735,083; 5,421,128; and 5,677,023 noted above and incorporated by reference herein. Those of ordinary skill in the art will also note that the ground anchors A are shown as being located at the corners of the planform defined by the subframes 10,10', but additional ground anchors A may be utilized as needed according to load requirements. Such ground anchors A may be either devices placed in the earth, or hardware attachments to a platform or floor assembly. Also, the shelter skin K,K' can be either external to the structural frame F,F', as shown, or suspended internally from the frame F,F'. The outer and inner diagonal tension elements 40*a*,40*b*,50 may be any type of cable, rope, cord, strap, or webbing, according to the specific design requirements. It is further understood that side diagonal elements 50 are optional and may be eliminated if the shelter skin fabric K,K' has sufficient shear stiffness.

A further embodiment of the present development replaces the inner diagonal tension members 50 with correspondingly located and arranged reinforcement webbing straps R sewn to the skin K,K' in a similar diagonal pattern for the same purpose.

It is particularly noted that the subframes 10,10' can comprise inflatable arches, and that the ridge beam 30,30' may also be an inflatable beam.

One benefit of the disclosed embodiments is that the shelter S,S' is braced without the need to employ stakes or ground anchors located outside the footprint P,P' of the shelter. Thus, neither stakes nor bracing wires, cables, or ropes will interfere with movement of people or objects in the vicinity of the shelter.

The present disclosure has been described with reference to several embodiments. Obviously, modifications and alterations will occur to others upon the reading and understanding of the preceding detailed description. It is intended that the present disclosure be construed as including all such modifications and alterations insofar as they come within the scope of the appended claims or the equivalents thereof.

What is claimed is:

1. A self-bracing shelter comprising:

a frame and a skin connected to said frame to define an internal space;

said frame comprising:

first and second subframes arranged in respective vertical planes, each subframe comprising first and second feet adapted to engage a support surface and a central portion that extends between and interconnects said first and second feet, wherein each of first and second subframes comprises an apex and defines an arch;

a ridge beam that extends axially between and interconnects the first and second subframes, said ridge beam located adjacent said apex of each subframe and comprising opposite first and second ends that extend axially beyond the first and second subframes, respectively, such that said opposite first and second ends of said ridge beam are located outside a habitable footprint of a planform defined by said feet of said first and second subframes;

a first pair of outer tension members, each tension member of said first pair connected at an outer end to said first end of said ridge beam and each tension member of said first pair connected at an inner end to said first subframe, wherein said respective inner ends of said first pair of outer tension members are connected to said first subframe on opposite lateral sides of said ridge beam at a location spaced laterally from said ridge beam;

a second pair of outer tension members, each tension member of said second pair connected at an outer end to said second end of said ridge beam and each tension member of said second pair connected at an inner end to said second subframe, wherein said respective inner ends of said second pair of outer tension members are connected to said second subframe on opposite lateral sides of said ridge beam at a location spaced laterally from said ridge beam;

wherein said first and second pairs of outer tension members urge the first and second sub-frames outwardly away from each other;

said first and second subframes each comprising a segmented arch subframe comprising: left and right upper linear segments that converge to define said apex; left and right lower linear segments connected respectively to the left and right upper linear segments and that are arranged vertically; and left and right shoulders defined respectively where said left and right upper linear segments join said left and right lower linear segments;

wherein:

said inner ends of said first pair of outer tension members are respectively connected to said first subframe adjacent said left and right shoulders of said first subframe; and, said inner ends of said second pair of outer tension members are respectively connected to said second subframe adjacent said left and right shoulders of said second subframe.

2. The self-bracing shelter as set forth in claim 1, wherein said ridge beam is located at and secured to said apex of each subframe, said ridge beam located either under said apex and inside said arch defined by each subframe or on top of and outside said arch defined by each subframe.

3. A self-bracing shelter comprising:

a frame and a skin connected to said frame to define an internal space;

said frame comprising:

first and second subframes arranged in respective vertical planes, each subframe comprising first and second feet adapted to engage a support surface and a central portion that extends between and interconnects said first and second feet, each of said first and second subframes comprising an apex and defining an arch;

a ridge beam that extends axially between and interconnects the first and second subframes, said ridge beam located adjacent said apex of each subframe and comprising opposite first and second ends that extend axially beyond the first and second subframes, respectively, such that said opposite first and second ends of said ridge beam are located outside a habitable footprint of a planform defined by said feet of said first and second subframes;

a first pair of outer tension members, each tension member of said first pair connected at an outer end to said first end of said ridge beam and each tension member of said first pair connected at an inner end to said first subframe, wherein said respective inner ends of said first pair of outer tension members are connected to said first subframe on opposite lateral sides of said ridge beam at a location spaced laterally from said ridge beam;

a second pair of outer tension members, each tension member of said second pair connected at an outer end to said second end of said ridge beam and each tension member of said second pair connected at an inner end to said second subframe, wherein said respective inner ends of said second pair of outer tension members are connected to said second subframe on opposite lateral sides of said ridge beam at a location spaced laterally from said ridge beam;

wherein said first and second pairs of outer tension members urge the first and second sub-frames outwardly away from each other a first pair of inner tension members attached to and extending between said first and second subframes and arranged in a crossing diagonal "X-shaped" pattern on a first lateral side of frame;

a second pair of inner tension members attached to and extending between said first and second subframes and arranged in a crossing diagonal "X-shaped" pattern on a second lateral side of frame.

4. The self-bracing shelter as set forth in claim 3, wherein said first and second subframes each comprise a segmented arch subframe each comprising:

left and right upper linear segments that converge to define said apex;

left and right lower linear segments connected respectively to the left and right upper linear segments and that are arranged vertically.

5. The self-bracing shelter as set forth in claim 3, wherein said first and second subframes each comprise a continuous arch subframe.

6. The self-bracing shelter as set forth in claim 3, wherein:

said first pair of inner tension members comprises a first inner tension member that extends between a location adjacent a first one of said feet of said first subframe and said second subframe, and a second inner tension member that extends between a location adjacent a first one of said feet of said second subframe and said first subframe;

said second pair of inner tension members comprises a first inner tension member that extends between a location adjacent a second one of said feet of said first subframe and said second subframe, and a second inner tension member that extends between a location adjacent a second one of said feet of said second subframe and said first subframe.

7. The self-bracing shelter as set forth in claim 3, wherein said skin comprises a fabric skin.

8. The self-bracing shelter as set forth in claim 7, wherein said skin comprises triangular vestibule panels located between the ridge beam and the first and second pairs of outer tension members.

9. The self-bracing shelter as set forth in claim 8, wherein said vestibule panels comprise respective reinforced edges that provide said first and second pairs of outer tension members.

10. A self-bracing shelter comprising:

a frame and a skin connected to said frame to define an internal space;

said frame comprising:

first and second subframes arranged in respective vertical planes, each subframe comprising first and second feet adapted to engage a support surface and a central portion that extends between and interconnects said first and second feet;

a ridge beam that extends axially between and interconnects the central portion of the first and second subframes, said ridge beam comprising opposite first and second ends that extend axially beyond the first and second subframes, respectively;

a first pair of outer tension members, each tension member of said first pair connected at an outer end to said first end of said ridge beam and each tension member of said first pair connected at an inner end to said first subframe, wherein said respective inner ends of said first pair of outer tension members are connected to said first subframe on opposite lateral sides of said ridge beam at a location spaced laterally from said ridge beam;

a second pair of outer tension members, each tension member of said second pair connected at an outer end to said second end of said ridge beam and each tension member of said second pair connected at an inner end to said second subframe, wherein said respective inner ends of said second air of outer tension members are connected to said second subframe on opposite lateral sides of said ridge beam at a location spaced laterally from said ridge beam;

wherein said first and second pairs of outer tension members urge the first and second sub-frames outwardly away from each other;

and wherein said skin comprises a fabric skin fabricated with diagonal webbing reinforcement to increase resistance to longitudinal loads on said self-bracing shelter.

11. The self-bracing shelter as set forth in claim 10, wherein said opposite first and second ends of said ridge beam are located outside a habitable footprint of a planform defined by said feet of said first and second subframes.

12. The self-bracing shelter as set forth in claim 10, wherein each of said first and second subframes comprises an apex and defines an arch, and wherein said ridge beam is located adjacent said apex of each subframe.

13. The self-bracing shelter as set forth in claim 10, wherein said first and second subframes comprise segmented, foldable metal or composite assemblies.

14. A self-bracing shelter comprising:

a frame and a skin connected to said frame to define an internal space;

said frame comprising:

first and second subframes arranged in respective vertical planes, each subframe comprising first and second feet adapted to engage a support surface and a central portion that extends between and interconnects said first and second feet;

a ridge beam that extends axially between and interconnects the central portion of the first and second subframes, said ridge beam comprising opposite first and second ends that extend axially beyond the first and second subframes, respectively;

a first pair of outer tension members, each tension member of said first pair connected at an outer end to said first end of said ridge beam and each tension member of said first pair connected at an inner end to said first subframe, wherein said respective inner ends of said first pair of outer tension members are connected to said first subframe on opposite lateral sides of said ridge beam at a location spaced laterally from said ridge beam;

a second pair of outer tension members, each tension member of said second pair connected at an outer end to said second end of said ridge beam and each tension member of said second pair connected at an inner end to said second subframe, wherein said respective inner ends of said second pair of outer tension members are connected to said second subframe on opposite lateral sides of said ridge beam at a location spaced laterally from said ridge beam;

wherein said first and second pairs of outer tension members urge the first and second sub-frames outwardly away from each other;

and wherein said first and second subframes comprise curved inflatable tubular structures.

15. A method of providing a self-bracing shelter, said method comprising:

erecting a frame and connecting a fabric skin to said frame to define an internal space, said step of erecting a frame comprising:

arranging first and second subframes in respective vertical planes, each subframe comprising first and second feet adapted to engage a support surface and a central portion that extends between and interconnects said first and second feet;

connecting a ridge beam to said first and second subframes so that said ridge beam extends axially between and interconnects the central portions of the first and second subframes, said ridge beam comprising opposite first and second ends that extend axially beyond the first and second subframes, respectively;

connecting a first pair of outer tension members between said first end of said ridge beam and said first subframe, wherein respective outer ends of said first pair of outer tension members are connected to said first end of said ridge beam and respective inner ends of said first pair of outer tension members are connected to said first subframe on opposite lateral sides of said ridge beam and spaced laterally outward from said ridge beam, to urge said first subframe outwardly away from said second subframe;

connecting a second pair of outer tension members between said second end of said ridge beam and said second subframe, wherein respective outer ends of said second pair of outer tension members are connected to said second end of said ridge beam and respective inner ends of said second pair of outer tension members are connected to said second subframe on opposite lateral sides of said ridge beam and spaced laterally outward from said ridge beam, to urge said second subframe outwardly away from said first subframe;

providing a first pair of inner tension members attached to and extending between said first and second subframes and arranged in a crossing diagonal "X-shaped" pattern on a first lateral side of frame;

providing a second pair of inner tension members attached to and extending between said first and second subframes and arranged in a crossing diagonal "X-shaped" pattern on a second lateral side of frame.

16. The method of providing a self-bracing shelter as set forth in claim 15, wherein:

said step of providing said first pair of inner tension members comprises providing a first inner tension member that extends between a location adjacent a first one of said feet of said first subframe and said second subframe, and providing a second inner tension member that extends between a location adjacent a first one of said feet of said second subframe and said first subframe; and, said step of providing said second pair of inner tension members comprises providing a first inner tension member that extends between a location adjacent a second one of said feet of said first subframe and said second subframe, and providing a second inner tension member that extends between a location adjacent a second one of said feet of said second subframe and said first subframe.

17. The method of providing a self-bracing shelter as set forth in claim 15, wherein said opposite first and second ends of said ridge beam are located outside a habitable footprint of a planform defined by said feet of said first and second subframes.

18. The method of providing a self-bracing shelter as set forth in claim 17, wherein each of said first and second subframes comprises an apex and defines an arch, and wherein said ridge beam is located adjacent said apex of each subframe.

* * * * *